US010314344B2

(12) United States Patent
Wittstadt et al.

(10) Patent No.: US 10,314,344 B2
(45) Date of Patent: Jun. 11, 2019

(54) BRASSIERE WITH STORAGE COMPARTMENT

(71) Applicant: Under Armour, Inc., Baltimore, MD (US)

(72) Inventors: Abby Wittstadt, New York, NY (US); Danielle Flower, New York, NY (US); Thomas Becker, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 27 days.

(21) Appl. No.: 15/810,882

(22) Filed: Nov. 13, 2017

(65) Prior Publication Data

US 2018/0132541 A1 May 17, 2018

Related U.S. Application Data

(60) Provisional application No. 62/420,686, filed on Nov. 11, 2016.

(51) Int. Cl.
*A41C 3/00* (2006.01)

(52) U.S. Cl.
CPC ..... *A41C 3/0035* (2013.01); *A41C 3/0057* (2013.01)

(58) Field of Classification Search
CPC ... A41C 3/0035; A41C 3/0014; A41C 3/0057; A41D 1/14; A41D 1/22; A41D 27/20; A41B 9/001
USPC ..... 450/89, 86, 36, 54–57; 2/247, 250, 220, 2/76, 67, 69
See application file for complete search history.

(56) References Cited

U.S. PATENT DOCUMENTS

| | | | | |
|---|---|---|---|---|
| 2,492,862 | A * | 12/1949 | Harvey | A41C 3/0035 150/101 |
| 2,503,847 | A | 4/1950 | Shanahan | |
| 2,610,325 | A | 9/1952 | Schlussel | |
| 2,624,881 | A | 1/1953 | Lee | |
| 2,920,628 | A | 1/1960 | York | |
| 4,699,144 | A | 10/1987 | Sherwood | |
| 5,067,178 | A | 11/1991 | Katchka | |
| 5,496,205 | A | 3/1996 | Lee | |
| 5,809,576 | A * | 9/1998 | Huston | A41D 27/20 2/247 |
| 5,855,124 | A | 1/1999 | Donaghy et al. | |
| 5,946,944 | A | 7/1999 | Osborne | |

(Continued)

FOREIGN PATENT DOCUMENTS

| | | | |
|---|---|---|---|
| DE | 3203872 | A1 | 8/1983 |
| JP | 2001020105 | A | 1/2001 |
| JP | 2011236531 | A | 11/2011 |

*Primary Examiner* — Gloria M Hale
(74) *Attorney, Agent, or Firm* — Edell, Shapiro & Finnan, LLC

(57) ABSTRACT

A brassiere disclosed herein includes a cup, a band coupled to and disposed below the cup, and a pocket disposed on the band. The pocket may be formed by an inner panel and an outer panel that are coupled together at their edges. The pocket may be sized and shaped to receive a portable electronic device. The outer panel of the pocket may be constructed from a mesh material that permits visibility of the contents of the pocket. The mesh material of the outer panel may also enable a wearer of the brassiere to activate or utilize the touch screen of a portable electronic device disposed within the pocket without removing the portable electronic device from the pocket or without reaching within the pocket.

19 Claims, 9 Drawing Sheets

(56) References Cited

U.S. PATENT DOCUMENTS 6,099,382 A 8/2000 Wilson
6,176,761 B1 1/2001 Underhill
6,178,784 B1 1/2001 Marley, Jr.
D448,541 S 10/2001 Robinson
6,443,805 B1 9/2002 Kirkwood
6,517,410 B1 2/2003 Underhill
6,551,171 B1 4/2003 Hass et al.
6,626,733 B1 9/2003 Knutson
6,993,940 B2 * 2/2006 Rabinowicz ..... A41D 13/0015 2/250
D522,717 S 6/2006 Aurilia et al.
D554,326 S 11/2007 Nuse
7,306,505 B2 12/2007 Barbour et al.
7,364,491 B2 4/2008 Updyke
7,396,274 B2 7/2008 Wiegmann
7,546,751 B2 6/2009 Lutz
D597,279 S 8/2009 Spillman
7,614,256 B2 11/2009 Mitchell
7,753,759 B2 7/2010 Pintor et al.
D623,378 S 9/2010 DiGeronimo
D625,488 S 10/2010 Messman et al.
D626,308 S 11/2010 DiGeronimo
D630,816 S 1/2011 Baramki
D630,817 S 1/2011 McKee
7,867,058 B2 1/2011 Sweeney
D641,954 S 7/2011 Glass
D646,461 S 10/2011 Lewando
8,083,693 B1 12/2011 McKeon et al.
D658,352 S 5/2012 Pinner
8,172,639 B2 5/2012 Swendseid
8,257,140 B2 9/2012 Kenny
8,398,453 B2 3/2013 Mitchell et al.
8,484,763 B1 7/2013 Lucas
8,597,071 B2 12/2013 Shweky et al.
8,597,072 B1 * 12/2013 Lucas ..... A41C 3/0035 2/247
8,771,036 B2 7/2014 Gentry et al.
8,898,816 B2 12/2014 Highfield
9,021,615 B2 5/2015 Cockram
9,060,550 B2 6/2015 Conrad
D733,394 S 7/2015 Gentry et al.
D741,566 S 10/2015 Perry et al.
D745,247 S 12/2015 Mazard
9,289,016 B1 3/2016 Goff
9,295,288 B1 3/2016 Goff
D754,948 S 5/2016 Cockram
9,943,120 B1 * 4/2018 Rendone ..... A41C 3/0014
2002/0100108 A1 8/2002 Stuart
2006/0121826 A1 * 6/2006 Nazzaro ..... A41C 3/0035 450/89
2007/0270078 A1 11/2007 Henry
2009/0069766 A1 3/2009 Bannister
2009/0209173 A1 8/2009 Arledge et al.
2009/0300818 A1 * 12/2009 Waite ..... A41D 1/14 2/76
2010/0035514 A1 2/2010 Wong et al.
2010/0281595 A1 * 11/2010 Gernes ..... A41B 9/001 2/69
2011/0223832 A1 * 9/2011 Rose ..... A41C 3/08 450/86
2011/0225700 A1 9/2011 Kogut
2011/0244758 A1 10/2011 Boatright et al.
2012/0030861 A1 * 2/2012 Miller ..... A41D 1/08 2/221
2012/0064799 A1 3/2012 Rivers
2012/0276812 A1 11/2012 Wollowick
2012/0304357 A1 * 12/2012 Highfield ..... A41D 1/002 2/69
2012/0311758 A1 * 12/2012 Nicholson ..... A41D 27/20 2/67
2013/0305433 A1 * 11/2013 Hedrick ..... A41D 1/22 2/220
2014/0051331 A1 2/2014 Handras
2014/0275906 A1 9/2014 Hackenburg
2015/0026869 A1 1/2015 Groceman
2015/0044943 A1 2/2015 Marshall et al.
2015/0074871 A1 3/2015 Emich et al.
2015/0196071 A1 7/2015 Cockram
2015/0257459 A1 9/2015 Cockram
2015/0264982 A1 9/2015 Randall et al.
2015/0296895 A1 10/2015 Muir
2015/0366280 A1 12/2015 Fay
2016/0088887 A1 3/2016 Cockram
2016/0120235 A1 5/2016 Scotto

* cited by examiner

BRASSIERE WITH STORAGE COMPARTMENT

CROSS-REFERENCE TO RELATED APPLICATIONS

This application claims priority under 35 U.S.C. 119(e) to U.S. Provisional Patent Application Ser. No. 62/420,686, entitled "Brassiere with Strap Storage Compartment," filed Nov. 11, 2016, the disclosure of which is incorporated herein by reference in its entirety for all purposes.

FIELD OF THE INVENTION

The present invention relates to an article of clothing or garment. More specifically, the present invention relates to brassiere that contains a pocket for storing or securing items.

BACKGROUND OF THE INVENTION

Women often use sports brassieres, or sports bras, for workouts and other athletic activities (e.g., team sports, running, cycling, etc.). Other articles of clothing worn by women during workouts, however, are often tight and form fitting, and may not include pockets to store or secure items. Thus, it would be desirable to provide a sports bra that is equipped with a pocket to secure or store items before, during, and after athletic activities. It would be further desirable to provide a sports bra equipped with a pocket that enables quick and easy access to a portable electronic device disposed within the pocket without requiring the removal of the portable electronic device from the pocket and/or without reaching within the pocket.

BRIEF SUMMARY OF THE INVENTION

A brassiere disclosed herein includes at least one cup, at least band coupled to and disposed below the cup, and a pocket disposed on the band. The pocket may be formed by an inner panel and an outer panel that are coupled together at their edges. The outer panel and the inner panel define an inner cavity configured to receive and retain objects. More specifically, the inner cavity of the pocket may be sized and shaped to receive and retain a portable electronic device. The outer panel of the pocket may be constructed from a mesh material that permits visibility of the contents of the pocket. The mesh material of the outer panel may also enable the activation and/or utilization of the touch screen of the portable electronic device disposed within the pocket without requiring the removal of the portable electronic device from the pocket or requiring users to reach within the pocket. The brassiere described herein enables women wearing the brassiere to secure or store items during athletic activities, while also providing quick and easy access to these stored items during the athletic activities.

Disclosed herein is an embodiment of a brassiere that includes at least one cup, a band coupled to and disposed below the cup, and a pocket disposed on the band. The pocket may be formed by an inner panel and an outer panel that are coupled together at their edges. The pocket may be sized and shaped to receive a portable electronic device. The outer panel of the pocket may be constructed from a mesh material that permits visibility of the contents of the pocket. The mesh material of the outer panel may also enable a wearer of the brassiere to activate or utilize the touch screen of a portable electronic device disposed within the pocket without removing the portable electronic device from the pocket or without reaching within the pocket.

In another embodiment, the brassiere may include a cup, a band, and a pocket. The band may be coupled to the cup of the brassiere. Furthermore, the pocket may be dispose don the band such that the pocket is disposed below the cup.

In yet another embodiment, the brassiere includes a first cup, a second cup, a band, and a pocket. The first cup may have a first side, a second side, and a first bottom side. The second cup may have a third side, a fourth side, and a second bottom side. The third side of the second cup being coupled to the second side of the first cup. The band may be coupled to the first bottom side of the first cup and the second bottom side of the second cup. Furthermore, the band may be configured to encircle a portion of a torso of a wearer of the brassiere. The pocket may be disposed on the band.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1A:
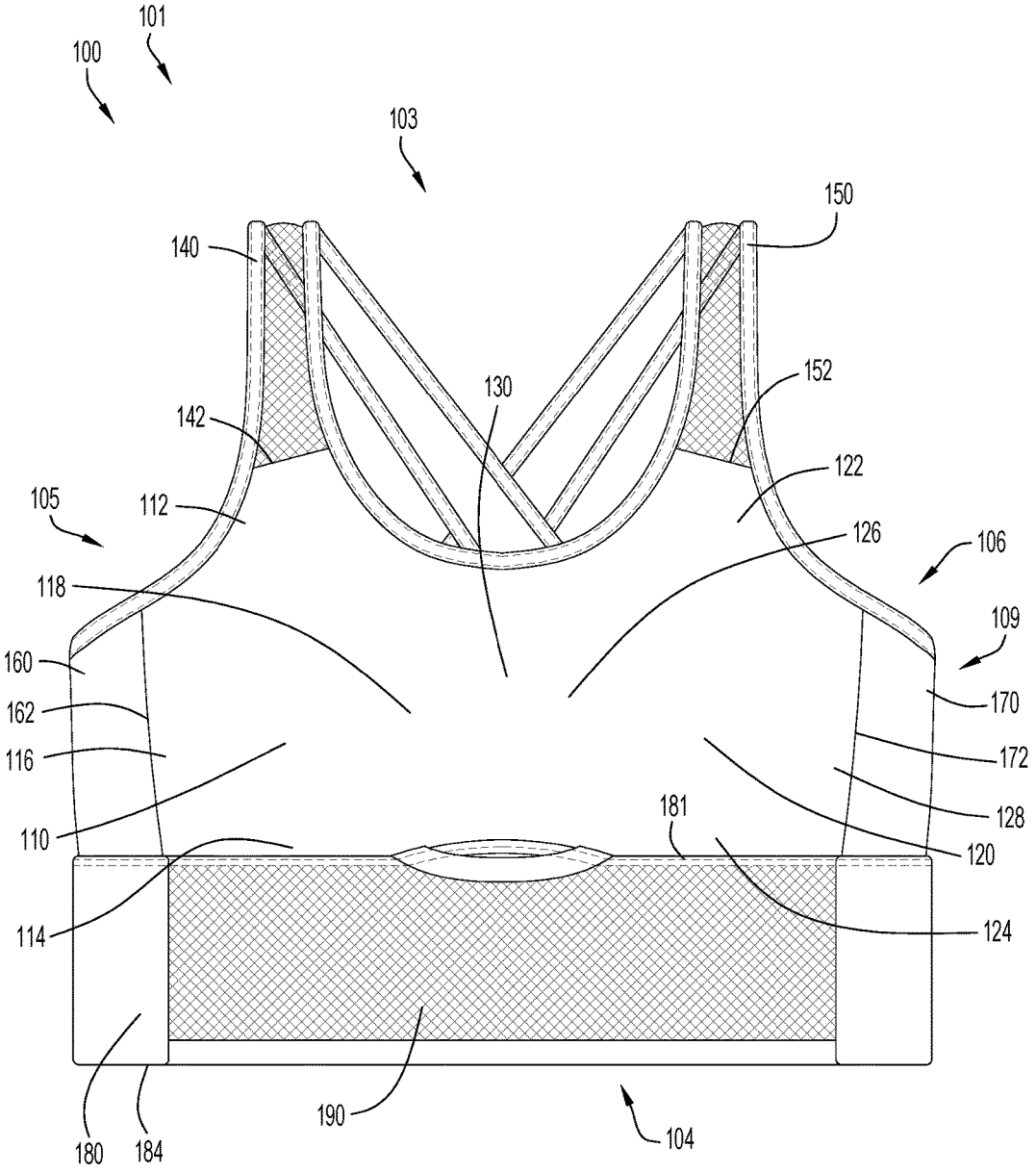
FIG. 1A illustrates a front view of a brassiere in accordance with an embodiment of the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Referring to FIGS. 1A, 1B, 2A, 2B, 3, 4A, 4B, 5A, and 5B, illustrated is an embodiment of a brassiere 100 that can be worn by a person. While the brassiere 100 illustrated in FIGS. 1A, 1B, 2A, 2B, 3, 4A, 4B, 5A, and 5B is a sports bra, the invention disclosed herein may be utilized in any type of brassiere. The brassiere 100 defines a front 101 side, a rear side 102, a top side 103, a bottom side 104 opposite the top side 103, a first (e.g., right) lateral side 105, and a second (e.g., left) lateral side 106 opposite the first side 105, along with an interior, user-facing side and an exterior side facing outward, away from the user.

The brassiere 100 includes a body 109 and a band 180 coupled to a lower end of the body. The body 109 includes a first cup 110, a second cup 120, and a bridge portion 130 connecting the first cup 110 to the second cup 120, as well as a first shoulder strap 140 extending substantially upward from the first cup 110, and a second shoulder strap 150 extending substantially upward from the second cup 120, with the straps spanning the front and rear sides of the brassiere. The body further includes a first wing portion 160 that extends laterally from the first cup 110 around the first side 105 to the rear side 102 of the brassiere 100, and a second wing portion 170 extending laterally from the second cup 120 around the second side 106 to the rear side 102 of the brassiere 100. The band 180 is configured to encircle the torso of the wearer. In other words, the band may be generally annular, extending around or encompassing the torso of a wearer of the brassiere 100. As illustrated, the band 180 is coupled to the lower end of the body via a connection line such as a seam 181.

The first cup 110 has a top side 112, a bottom side 114 opposite the top side 112, a first side 116, and a second side 118 opposite the first side 116. Similarly, the second cup 120 has a top side 122, a bottom side 124 opposite the top side 122, a first side 126, and a second side 128 opposite the first side 126. Thus, the first cup 110 and the second cup 120 may be substantially similar to one another, and may be mirror images of one another. As further illustrated, the bridge 130 is coupled to, and uniformly formed with, the second end 118 of the first cup 110 and the first end 126 of the second cup 120 to connect the first cup 110 and the second cup 120 across the chest or breast of the wearer of the brassiere 100. More specifically, when worn, the bridge 130 may be disposed proximate to the sternum of a wearer of the brassiere 100, while the first cup 110 receives and supports a first (e.g., right) breast of the wearer and the second cup 120 receives and supports a second (e.g., left) breast of the wearer.

Figure 1B:
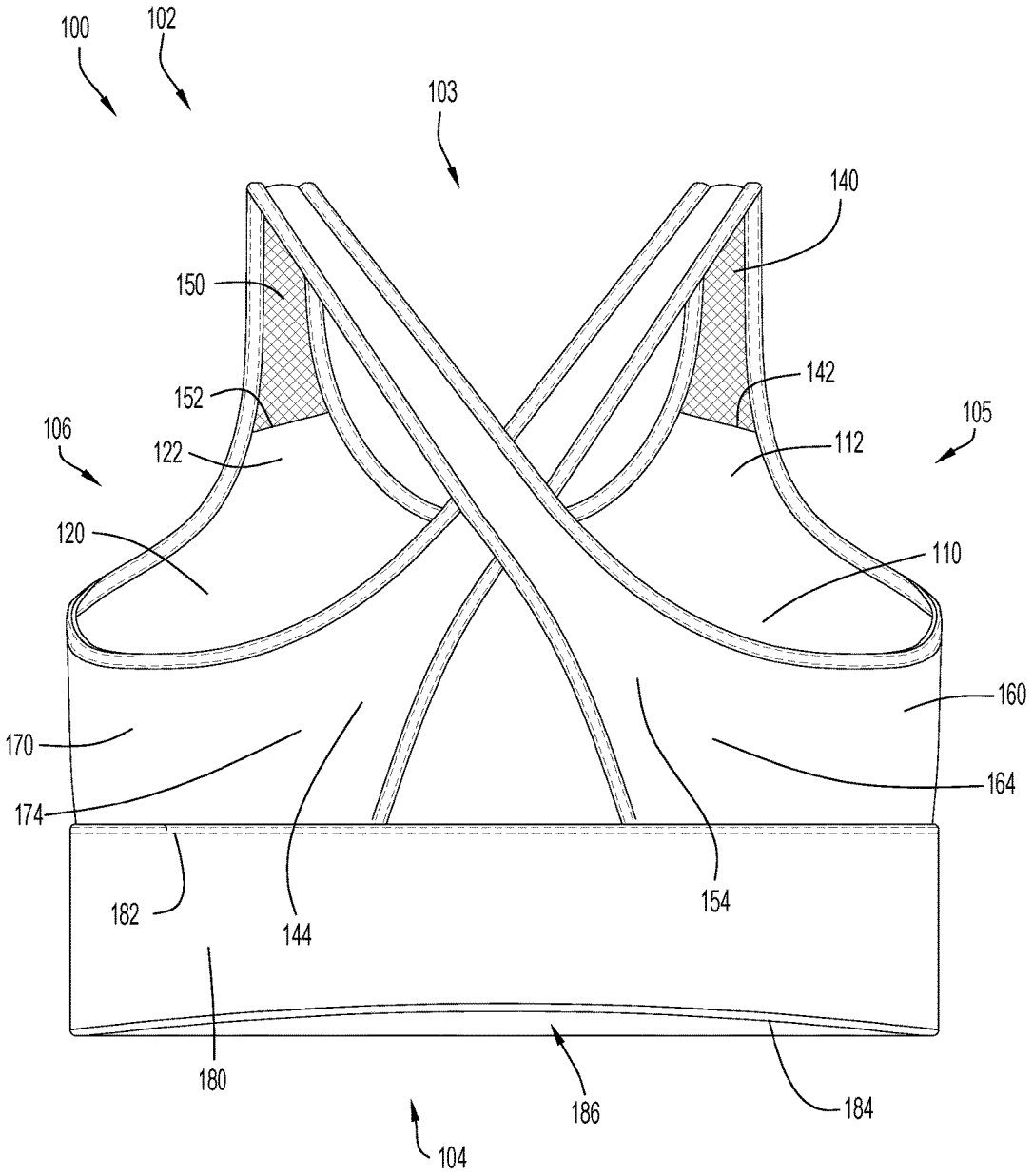
FIG. 1B illustrates a rear view of the embodiment of the brassiere illustrated in FIG. 1A.

As previously explained, the brassiere 100 includes a first wing 160 and a second wing 170. The first wing 160 may include a first end 162 and a second end 164, where the first end 162 is coupled to the first side 116 of the first cup 110. The first end 162 of the first wing 160 may be coupled to the first side 116 of the first cup 110 by any conventional means, including, but not limited to, stitching, bonding, adhesives, etc. In another embodiment, the first side 162 of the first wing may be uniformly formed with the first end 116 of the first cup 110. As illustrated in FIGS. 1A and 1B, the first wing 160 extends from the first cup 110 around the first side 105 to the rear side 102 of the brassiere 100, where the second end 164 of the first wing 160 is disposed on the rear side 102 of the brassiere 100. Thus, the second end 164 of the first wing 160 is disposed proximate to the back of the wearer of the brassiere 100.

Similar to the first wing 160, the second wing 170 may include a first end 172 and a second end 174, where the first end 172 is coupled to the second side 128 of the second cup 120. Similar to the first wing 160, the first end 172 of the second wing 170 may be coupled to the second side 128 of the second cup 120 by any conventional means, including, but not limited to, stitching, bonding, adhesives, etc. In another embodiment, the first side 172 of the second wing 170 may be uniformly formed with the second end 128 of the second cup 120. As illustrated in FIGS. 1A and 1B, the second wing 170 extends from the second cup 120 around the second side 106 to the rear side 102 of the brassiere 100, where the second end 174 of the second wing 170 is disposed on the rear side 102 of the brassiere 100. Thus, the second end 174 of the second wing 170 is disposed proximate to the back of the wearer of the brassiere 100. As best illustrated in FIG. 1B, the second end 164 of the first wing 160 may be spaced from the second end 174 of the second wing 170. In another embodiment, the second end 164 of the first wing 160 may be coupled to the second end 174 of the second wing 170 proximate to the rear side 102 of the brassiere 100.

As previously noted, the first strap 140 extends substantially upward from the first cup 110, while the second strap 150 extends substantially upward from the second cup 120. The first strap 140 is elongated and includes a first end 142 and a second end 144. The first end 142 of the first strap 140 may be coupled to, and uniformly formed with, the top side 112 of the first cup 110. The second strap 150 is also elongated and also includes a first end 152 and a second end 154. Similar to the first strap 140, the first end 152 of the second strap 150 may be coupled to, and uniformly formed with, the top side 122 of the second cup 120. When the brassiere 100 is worn, both the first strap 140 and the second strap 150 extend upward from the first and second cups 110, 120, respectively, such that the first and second straps 140, 150 extend over the shoulders of the wearer of the brassiere 100. The second end 144 of the first strap 140 may be coupled to, and uniformly formed with, the second end 174 of the second wing 170, while the second end 154 of the second strap 150 may be coupled to, and uniformly formed with, the second end 164 of the first wing 160. Thus, the second end 144 of the first strap 140 and the second end 154 of the second strap 150 are disposed on the rear side 102 of the brassiere 100, and may be disposed proximate to the backside of a wearer the brassiere 100. Furthermore, as best illustrated in FIG. 1B, the first strap 140 and the second strap 150 intersect and cross each other (i.e., the first strap 140 crosses over the second strap 150, or vice versa) on the rear side 102 of the brassiere 100. Thus, the straps 140, 150 cross over each other on the backside of the wearer the brassiere 100.

The material forming the body of the brassiere may be any suitable for its intended purpose. The material is a textile possessing a predetermined elongation and recovery values. Elongation is the deformation in the direction of load caused by a tensile force. Elongation may be measured in units of length (e.g., millimeters, inches, etc.) or may be calculated as a percentage of the original specimen length in its relaxed (unstretched) position. Typically, elongation is measured at a specified load such as the breaking load. In an embodiment, the first textile layer is a stretch or elastic fabric. Elastic or stretch fabrics are fabrics which are able to expand under load and regain their original form when the load is removed (a property called recovery). Elastic and stretch fabrics are typically made from an elastomer (i.e., fibers, filaments or yarn including an elastomer), either alone or in combination with other (non-elastomer) fibers, filaments, or yarns. Elastomers include, but are not limited to, rubber, polybutadiene, thermoplastic polyurethane, polyester-polyurethane copolymers (spandex/elastane), a biconstituent filament (elasterell), an elastoester, lastol, and polyisoprene (elastodiene). Elastomers may be integrated as raw fibers, or may be woven, bundled, or braided into the fabric. In addition, some stretch fabrics may be formed without the use of elastomers.

Elastomeric fibers are typically used in combination with relatively inelastic fibers, such as polyester, cotton, nylon, rayon or wool (called hard fibers). In an embodiment, the proportion of elastomeric fibers in the fabric may include about 20% by weight or less (e.g., from about 1% to about 20% by weight) to provide desired stretch and recovery properties of the fabric. In another embodiment, the elastomer concentration is greater than 20%. By way of example, the textile includes a blend of polyester and elastane (e.g., 75-95 wt % polyester (e.g., about 87 wt %) and 5-20 wt % elastane (about 13 wt %)).

By way of further example, the textile layer forming the brassiere body may be a comfort stretch fabric or a power stretch fabric. Comfort stretch fabrics generate an elongation of less than 30% (e.g., about 5%-30%) under load. Stated another way, comfort stretch fabric is a term that applies to fabrics with less than 30% stretch factors. Power stretch fabrics generate an elongation of about 30% to about 50%. Accordingly, power stretch fabrics have a higher degree of extensibility, as well as quick recovery. Stretch factors generally range from 30% to 50% and with no more than 5% to 6% loss in recovery. In still other embodiments, the first textile layer 205 may be a fabric having or over 100% stretch factors (elongation).

The elastic or stretch fabric may be a mono-elastic fabric, which stretches in a single, longitudinal or horizontal direction (also called a two-way stretch fabric) or bi-elastic fabric, which stretch in both longitudinal and horizontal directions (also called a four-way stretch fabric.

The textile layer is preferably a knit fabric. Knit fabrics include interlocking looped stitches, with the interlocking loops of yarn creating lengthwise ribs called wales and crosswise lines called courses. In single knits, the wales are visible from the right side of the fabric and the courses are visible on the fabric's wrong side. Knitting can further be used to provide elongation properties to the first textile layer. Knit fabrics are typically classified by their amount of stretch. Firm, stable knits have very little stretch. Moderate stretch knits are those that stretch about 25% in the crosswise direction. In an embodiment, the resilient textile is a warp knit fabric.

As previously explained, the band 180 may form the bottom 104 of the brassiere 100. The band 180 includes a top edge 182 and a bottom edge 184 opposite the top edge 182. The top edge 182 may be coupled to the body along the bottom side 114 of the first cup 110 and the bottom side 124 of the second cup 120, as well as the bridge 130 and the first and second wings 160, 170. As best illustrated in FIG. 1B, the band 180 may extend continuously around the torso of the wearer such that the band 180 encircles the torso of the wearer to define a generally annular bottom opening 186. When the brassiere 100 is worn, a portion of the torso of the wearer may be disposed within the opening 186 of the band such that the band 180 wraps around and encompass that portion of the torso of the wearer the brassiere 100.

The band 180 possess a resilient construction. In an embodiment, the band 180 or portions thereof may be more resilient than the body of the brassiere 100. By way of example, the body may include a comfort stretch fabric while the band may include a power stretch fabric. The resiliency of the band 180 enables the band 180 to impart compression force on the portion of the torso of the wearer so that the band 180 secures the brassiere 100 in place on the wearer. This resilient or compression force further enables the brassiere 100 to provide proper support to the wearer of the brassiere 100.

The band 180, moreover, may include one or more band sections or portions. As best illustrated in FIG. 1A, the band 180 includes pocket section 400 located within the front side 101 of the bra 100 and a non-pocket or support section 410 extending from one lateral end to the edge of the pocket section to the opposite edge of the pocket section, traversing the sides and back of the wearer. The band support section 410 includes a resilient textile that is folded over to form a continuous, double-layered construction having an exterior or outward-facing layer 310 and an interior or user-facing layer 320. The resilient textile may be similar to that described above for the textile body. In other embodiments, a resilient reinforcing membrane is positioned between the exterior and interior layers such that the membrane generally spans the height and length of band support section 410. The resilient membrane may be an elastomer film such as a thermoplastic polyurethane (TPU) film. Still further, the membrane may be perforated to permit airflow through the band support section 410. The film may further possess adhesive properties such that it secures the exterior layer to the interior layer. Exemplary commercial reinforcing membranes include SEWFREE and FLOWFREE membranes, available from BEMIS (Bemis Associates Inc., Shirley, Mass.).

Figure 2A:
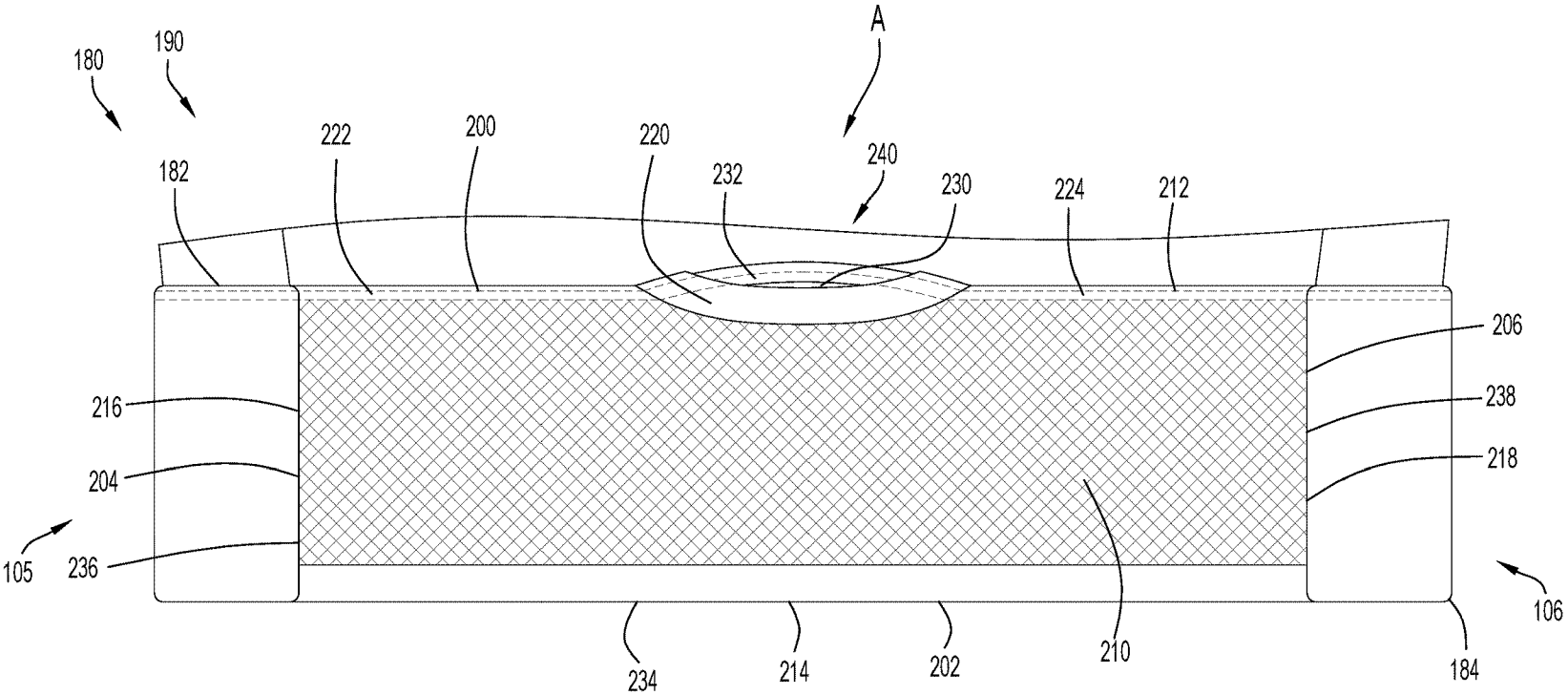
FIG. 2A illustrates a front view of a pocket of the embodiment of the brassiere illustrated in FIG. 1A.
Figure 2B:
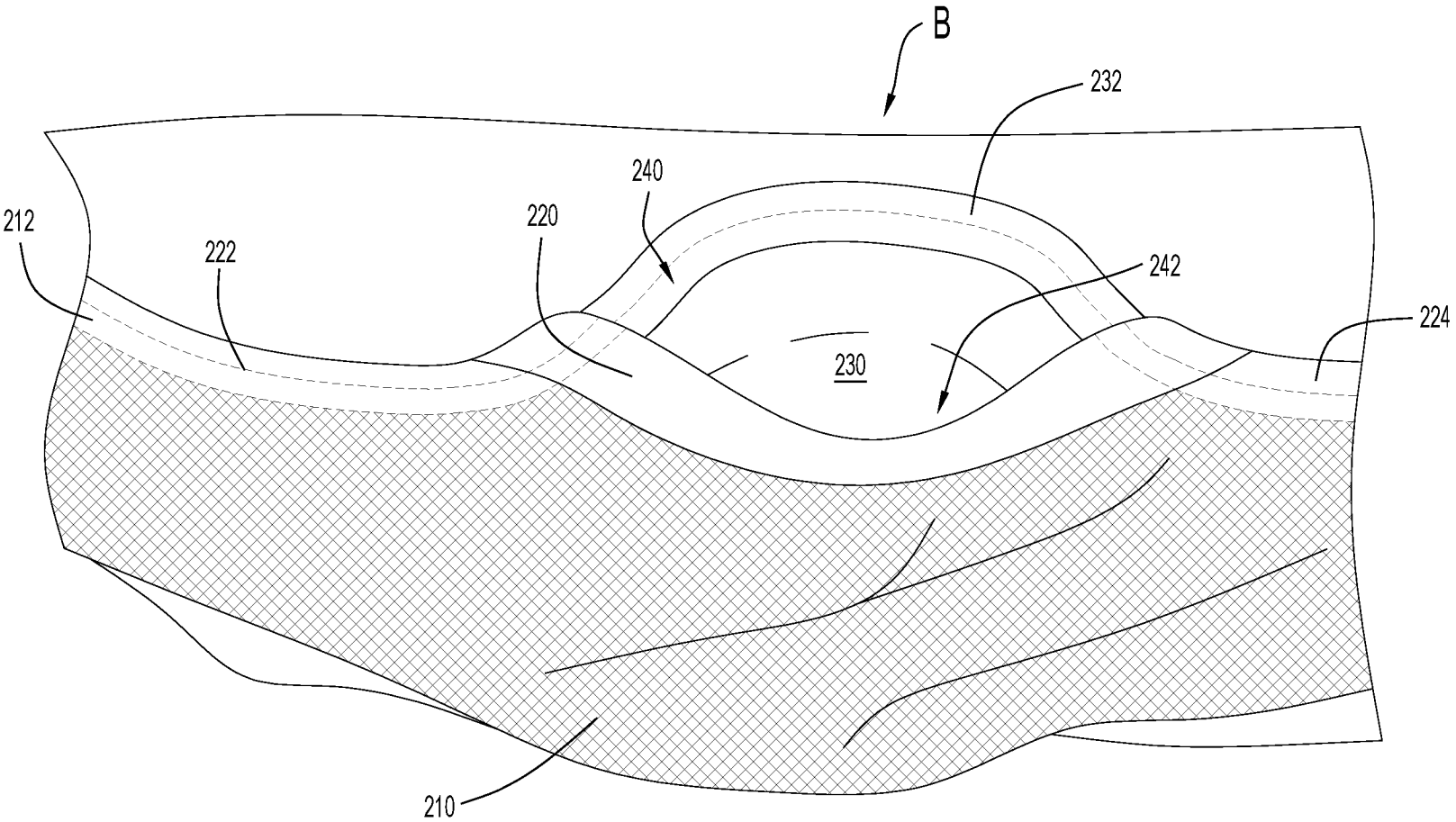
FIG. 2B illustrates a top view of an opening of the pocket of the embodiment of the brassiere illustrated in FIG. 2A.
Figure 4A:
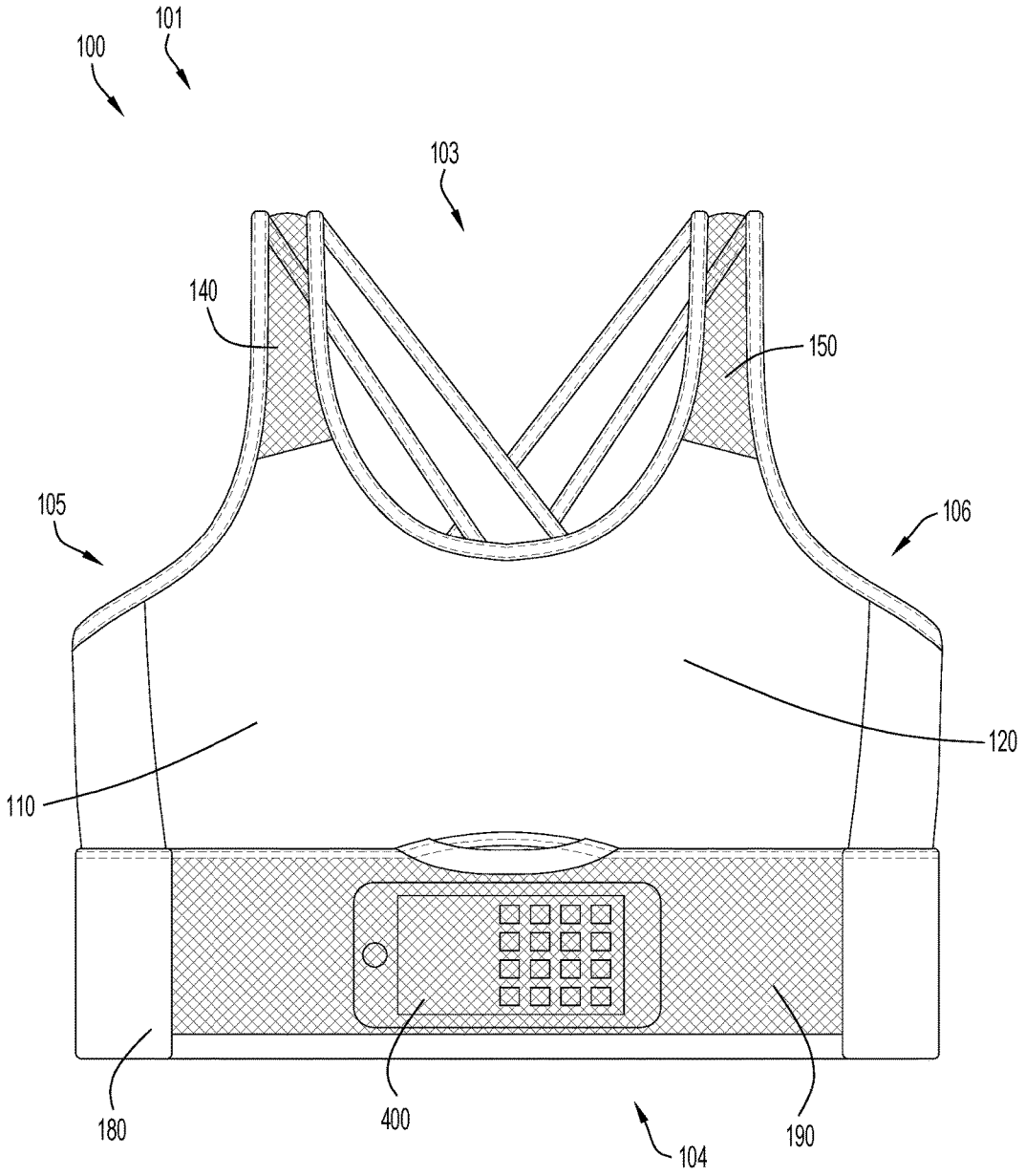
FIG. 4A illustrates a front view of the embodiment of the brassiere illustrated in FIG. 1A, the front view showing an electronic device disposed within the pocket.
Figure 4B:
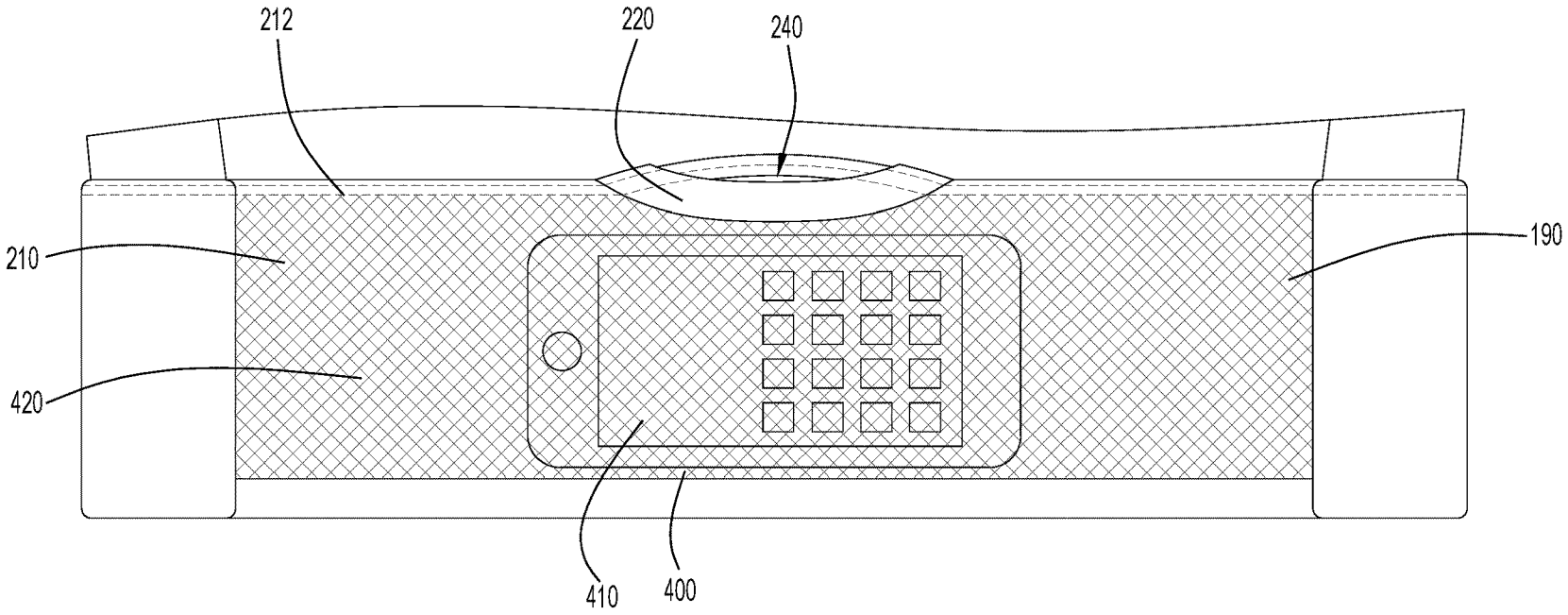
FIG. 4B illustrates a perspective view of the pocket of the embodiment of the brassiere illustrated in FIG. 1A and the electronic device disposed within the pocket.

The pocket section 400 includes a pocket 190 disposed on, or integrally formed with, the band 180 on the front side 101 of the brassiere 100. The pocket section 400 preferably includes the same folded double layer band construction as the support section 410. In should be understood, however, that the support section 410 may possesses a construction including a single layer of the resilient textile. Turning to FIGS. 2A and 2B, the pocket 190 of the brassiere 100 includes a top edge 200, a bottom edge 202 opposite the top edge 200, a first edge 204, and a second edge 206 opposite the first edge 204. Because the pocket 190, as illustrated, covers the entire height of the band 180 on the front side 101 of the brassiere 100, the top edge 200 of the pocket 190 is aligned with the top edge 182 of the band 180 and the bottom edge 202 of the pocket 190 is aligned with the bottom edge 184 of the band 180. In other words, the top edge 200 of the pocket 190 may form at least a portion of the top edge 182 of the band 180 and the bottom edge 202 of the pocket 190 may form at least a portion of the bottom edge 184 of the band 180. Furthermore, the first edge 204 of the pocket 190 may be disposed proximate to the first side 105 of the brassiere 100 while the second edge 206 of the pocket 190 may be disposed proximate to the second side 106 of the brassiere 100. The pocket 190 of the brassiere 100 may be constructed from a first, or outer, fabric panel 210 (also called a cover panel) connected to the outer layer of the band 180 such that the band defines a second, or inner, fabric panel 230. As illustrated in FIGS. 4A and 4B, the first fabric panel 210 of the pocket 190 may be constructed from a porous material 420 such as a textile formed of strands (e.g., yarn) interconnected (via knitting, weaving, embroidery, etc.) to define openings, spaces or apertures between the strands. By way of example, the textile is an open mesh fabric.

The strands forming the cover panel textile may be any natural or synthetic strands suitable for their described purpose (i.e., to form a knit upper). The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strand includes elastic strands and inelastic strands. Elastic strands are strands formed of elastomeric material. Elastic strands, by virtue of their composition alone, are capable of stretching under stress and recovery to its original size once the stress is released. Accordingly, elastic strands are utilized to provide a textile upper with stretch properties. An elastic strand is formed rubber or a synthetic polymer having properties of rubber. A specific example of an elastomeric material suitable for forming an elastic strand is an elastomeric polyester-polyurethane copolymer such as elastane, which is a manufactured fiber in which the fiber-forming substance is a long chain synthetic polymer composed of at least 85% of segmented polyurethane.

In contrast, an inelastic is formed of a non-elastomeric material. Accordingly, inelastic strands possess no inherent stretch and/or recovery properties by virtue of composition. Hard yarns are examples of inelastic strands. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate)) fibers and poly(trimethylene terephthalate) fibers), polycaprolactam fibers, poly(hexamethylene adipamide) fibers, acrylic fibers, acetate fibers, rayon fibers, nylon fibers and combinations thereof.

In an embodiment, the strands are a combination of resilient strands and hard strands. By way of specific example, textile is a warp knit mesh fabric containing 60% elastane and 40% nylon. With this configuration, the first fabric panel 210 may be resilient and stretchable, which enables the first fabric panel 210 to conform to the shape of the items disposed within the pocket 190. The resiliency of the porous material 420 of the first fabric panel 210 may also force any object disposed within the interior cavity 242 of the pocket 190 against the second fabric panel 230.

Accordingly, the porous material is a textile having an array of apertures across its surface (e.g. a mesh fabric). The size of the apertures should be sufficient to permit visibility of and contact with an object (explained more below) while maintaining the object within the pocket storage cavity. In an embodiment, the aperture size is about 0.5 mm to about 2.5 mm (e.g., about 1 mm).

In the embodiment illustrated, the first fabric panel 210 may be substantially rectangular with a top edge 212, bottom edge 214, a first side edge 216, and a second side edge 218. The top edge 212 of the first fabric panel 210 may be divided into three sections 220, 222, 224. The first section 220 of the top edge 212 of the first fabric panel 210 may be centrally disposed between the second section 222 and the third section 224. While the second and third sections 222, 224 of the top edge 212 of the first fabric panel 210 are substantially straight edges, the first section 220 may be a curved or arched edge. The second fabric panel 230 may also be substantially rectangular with a top edge 232, bottom edge 234, first side edge 236, and second side edge 238. The first fabric panel 210 and the second fabric panel 220 may be substantially similar in shape and size.

The top edge 212 of the first fabric panel 210 may be coupled to the top edge 232 of the second fabric panel 230. More specifically, the second section 222 and the third section 224 of the top edge 212 of the first fabric panel 210 may be coupled to the top edge 232. The first section 220 of the top edge 212 of the first fabric panel 210, however, may be uncoupled from the top edge 232 of the second fabric panel 230 such that, as explained below, the first section 220 of the top edge 212 of the first fabric panel 210 may be at least partially separated or spaced from the top edge 232 of the second fabric panel 230. In addition, the bottom edge 214 of the first fabric panel 210 may be coupled to the bottom edge 234 of the second fabric panel 230. The first side edge 216 of the first fabric panel 210 may be coupled to the first side edge 236 of the second fabric panel 230, while the second side edge 218 of the first fabric panel 210 may be coupled to the second side edge 238 of the second fabric panel 230. The coupling of the edges 212, 214, 216, 218 of the first fabric panel to the edges 232, 234, 236, 238 of the second fabric panel 230, respectively, may be by any conventional means, including, but not limited to, stitching, adhesives, bonding, etc.

As best illustrated in FIG. 2A, the second and third sections 222, 224 of the top edge 212 of the first fabric panel 210 are coupled to the top edge 232 of the second fabric panel 230 via stitching. Furthermore, the side edges 216, 218 of the first fabric panel 210 are also coupled to the side edges 236, 238 of the second fabric panel 230, respectively, via stitching. The bottom edge 214 of the first fabric panel 210 and the bottom edge 234 of the second fabric panel 230 may be formed by the folding of a unitary piece of fabric along a straight fold line such that the fold line forms the bottom edge 184 of the band 180. In other embodiments, the bottom edge 214 of the first fabric panel 210 and the bottom edge 234 of the second fabric panel 230 may be coupled to one another via stitching.

The coupling of the second and third sections 222, 224 of the top edge 212 of the first fabric panel 210 to the top edge 232 of the second fabric panel 230 defines the top edge 200 of the pocket 190. The coupling of the first side edge 216 of the first fabric panel 210 to the first side edge 236 of the second fabric panel 230 defines the first side edge 204 of the pocket 190. Similarly, the coupling of the second side edge 218 of the first fabric panel 210 to the second side edge 238 of the second fabric panel 230 defines the second side edge 206 of the pocket 190. Lastly, the coupling of the bottom edge 214 of the first fabric panel 210 to the bottom edge 234 of the second fabric panel 230 defines the bottom edge 202 of the pocket 190.

Because the first section 220 of the top edge 212 of the first fabric panel 210 is uncoupled from the top edge 232 of the second fabric panel 230, the first section 220 can be reconfigured between a closed configuration A (FIG. 2A) and an open configuration B (FIG. 2B). In the closed configuration A, the first section 220 of the top edge 212 of the first fabric panel 210 is disposed adjacent to, or abutting, the second fabric panel 230. In the open configuration B, however, the first section 220 of the top edge 212 of the first fabric panel 210 is spaced from the second fabric panel 230 such that the first section 220 and a portion of the top edge 232 of the second fabric panel 230 collectively form an opening 240. In some embodiments, the opening 240 may be present regardless of whether the first section 220 is in the closed configuration A or the open configuration B. According to these embodiments, the opening 240 may be largest when the first section 220 is in the open configuration B, and the opening 240 may be smallest when the first section 220 is in the closed configuration A.

As best illustrated in FIG. 2B, the interstitial space between the first fabric panel 210 and the second fabric panel 230 forms the internal cavity 242 of the pocket 190, which is configured to receive and house items disposed within the pocket 190. The opening 240 provides access to the internal cavity 242 of the pocket 190, where items may be disposed within the internal cavity 242 of the pocket 190 by sliding the items through the opening 240 when the first section 220 of the top edge 212 of the first fabric panel 210 is placed in the open configuration B.

As best illustrated in FIGS. 4A and 4B, the pocket 190 is sized and shaped to receive a portable electronic device 400 (e.g., cellular telephone). As previously described, the internal cavity 242 of the pocket 190 is accessible through the opening 240 formed by the first section 220 of the top edge 212 of the first fabric panel 210 and the top edge 232 of the second fabric panel 230 when the first section 220 is reconfigured to the open configuration B (i.e., the first section 220 is pulled away/separated from the top edge 232 of the second fabric panel 230). The first section 220 of the top edge 212 of the first fabric panel 210 may be resilient and configured to stretch. Thus, when reconfiguring the first section 220 from the closed configuration A to the open configuration B, the first section 220 may be stretched to enlarge the opening 240 to a size that enables the opening 240 to receive a portable electronic device 400. Insertion of a portable electronic device 400 through the opening 240 enables the portable electronic device 400 to be disposed within in the pocket 190. In some embodiments, the resiliency of the first section 220 of the top edge 212 of the first fabric panel 210 enables the first section 220 to be stretched to enlarge the opening 240 to a size capable of receiving a portable electronic device 400 that is disposed within a protective case or covering. In addition, the resiliency of the first section 220 of the top edge 212 of the first fabric panel 210 also causes the first section 220 to return to the closed configuration A when the force configuring the first section 220 to the opening configuration B is removed or eliminated. As previously explained, the opening 240 is smaller, or not present, when the first section 220 of the top edge 212 of the first fabric panel 210 is in the closed configuration A than when the first section 220 is in the open configuration B. Thus, when the first section 220 of the first fabric panel 210 is in the open configuration B, a portable electronic device 400 may be inserted into the pocket 190 through the opening 240, but when the first section 220 is in the closed configuration A, a portable electronic device 400 placed inside the pocket 190 is prevented from exiting the pocket 190. Furthermore, when the first section 220 is in the closed configuration A, a portable electronic device 400 located outside of the pocket 190 is prevented from entering the pocket 190.

Once the portable electronic device 400 is inserted through the opening 240, the portable electronic device 400 is disposed within the interior cavity 240 of the pocket 190. In some embodiments, the pocket 190 is sized to receive a portable electronic device 400 disposed within a protective case.

In addition, the porous material 420 of the first fabric panel 210 permits light to shine therethrough. Thus, as illustrated in FIGS. 4A and 4B, the object stored within the pocket storage cavity (e.g., a portable electronic device 400) can be seen by the wearer of the garment, with the object being visible through the porous material 420 of the first fabric panel 210 of the pocket 190. For example when the object is a portable electronic device 400 such as a mobile phone, the phone may be disposed within the pocket 190 such that the display screen 410 of the portable electronic device 400 is visible through the first fabric panel 210 (i.e., the display screen 410 of the portable electronic device 400 is oriented outward, being disposed against the first fabric panel 210). With the porous material (mesh fabric) configuration, the user may view the phone (e.g., to check banner notifications) without removing the phone from the pocket, especially when illuminated to display items on the display screen 410.

Additionally, the porous material (mesh fabric) configuration enables interaction with the object positioned within the pocket storage cavity, it permits direct contact by the wearer through the apertures of the porous material. For example, in the event the portable electronic device 400 contains a touch-enabled display screen 410, the porous material 420 of the first fabric panel 210 of the pocket 190 enables the wearer of the brassiere 100 to manipulate the touch-enabled display screen 410 of the portable electronic device 400 through the first fabric panel 210. In other words, the capacitive sensors of the touch-enabled display screen 410 may be activated, or may function, through the porous material 420 of the first fabric panel 210. Thus, the porous material 420 of the first fabric panel 210 of the pocket 190 may enable the wearer of the brassiere 100 to activate and manipulate the touch-enabled display screen 410 in order to perform functions (e.g., check the time on their portable electronic device 400, change the music played by the portable electronic device 400, respond to messages received by the portable electronic device 400) without removing the portable electronic device 400 from the pocket 190 or without inserting their fingers into the interior cavity 242 of the pocket 190. This is achieved via the skin contact of the screen through the apertures.

The porous material 420 also permits the flow of fluid (e.g., air, moisture, etc.) therethrough. Therefore, air is able to enter and leave the interior cavity 242 of the pocket 190 through the porous material 420. This prevents moisture from building up and storing within the interior cavity 242 of the pocket 190, which could potentially damage a portable electronic device 400 disposed within the pocket 190. Thus, the pocket 190 provides a location on the brassiere 100 for storage of a portable electronic device 400 while wearing the brassiere 100 during workouts and/or other activities. The porous material 420 of the first fabric panel 210 of the pocket 190 further promotes the use of a portable electronic device 400 stored within the pocket 190 during workouts and/or other activities.

Figure 5A:
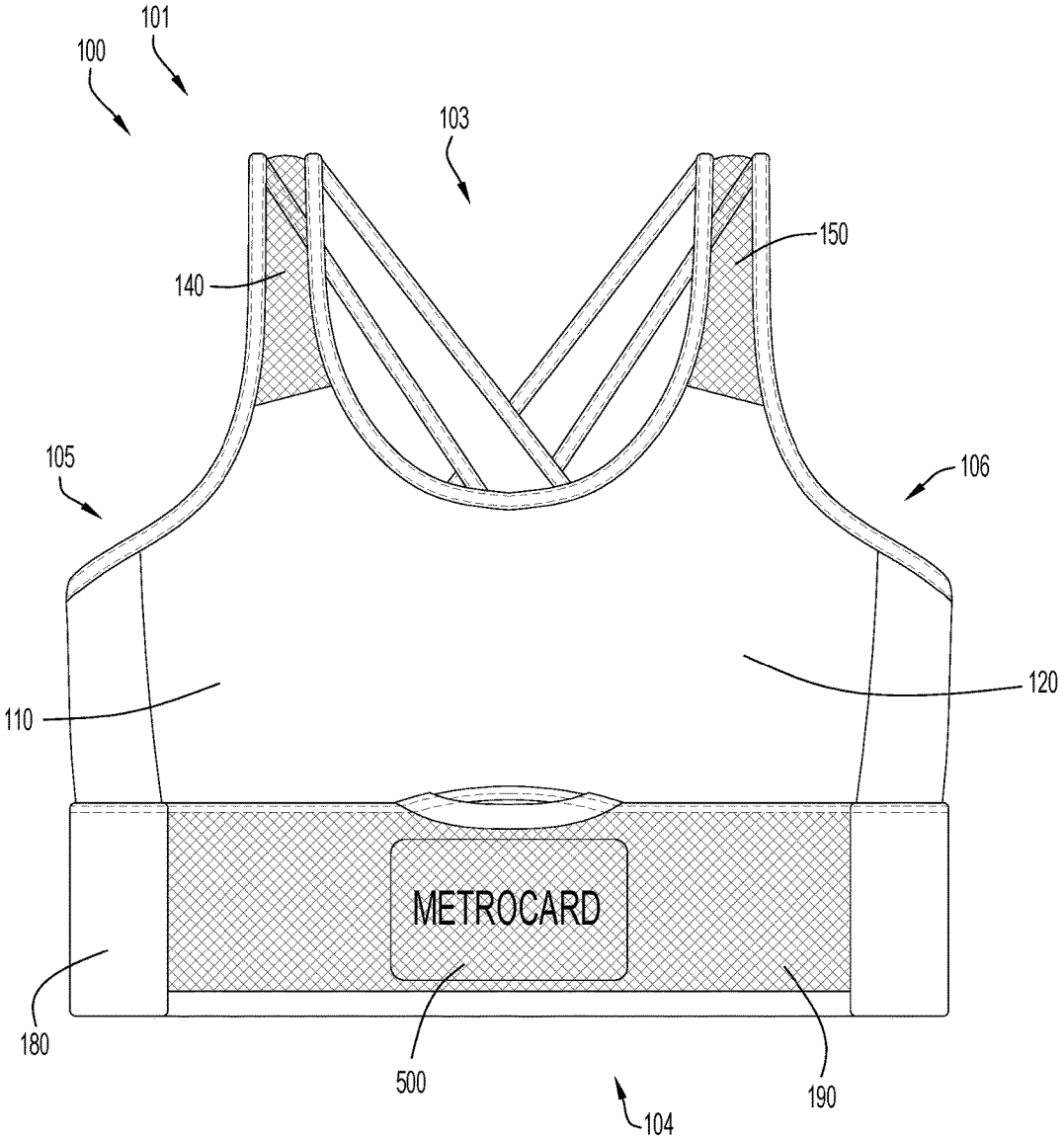
FIG. 5A illustrates a front view of the embodiment of the brassiere illustrated in FIG. 1A, the front view showing an identification or credit card disposed within the pocket.
Figure 5B:
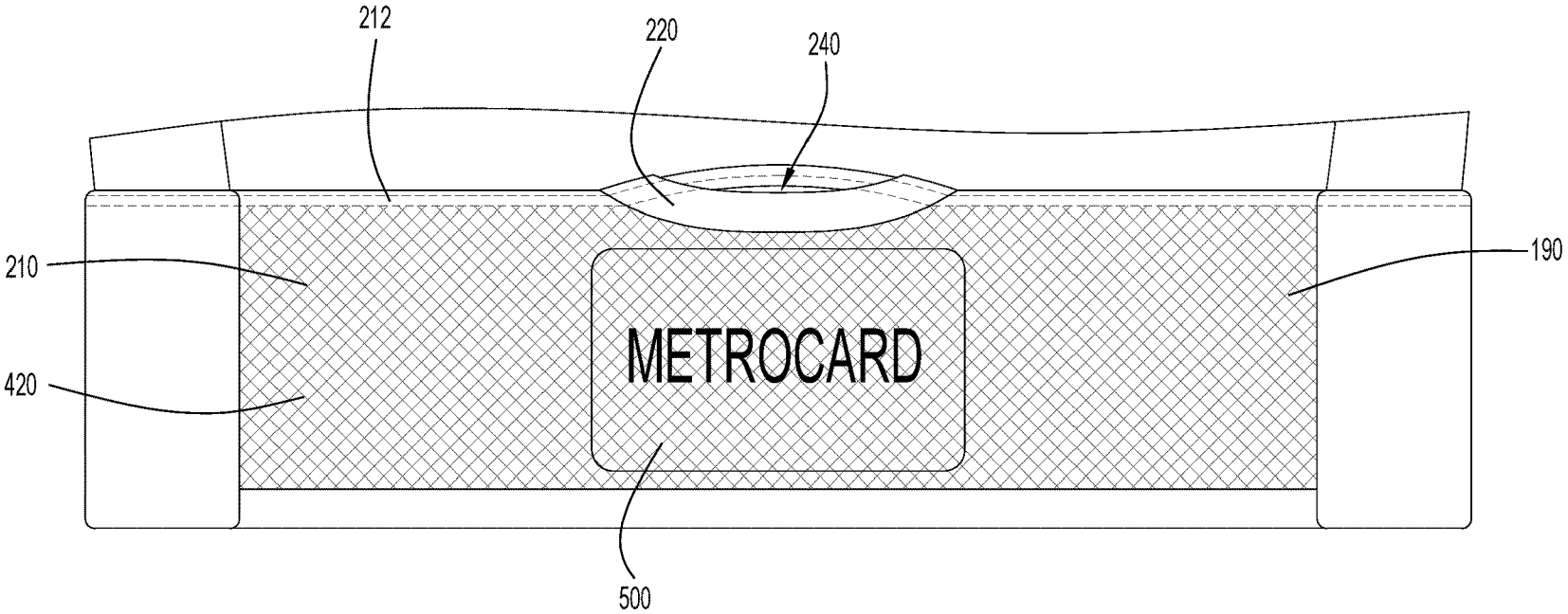
FIG. 5B illustrates a perspective view of the pocket of the embodiment of the brassiere illustrated in FIG. 1A and the identification or credit card disposed within the pocket.

Items and objects other than a portable electronic device 400, such as card(s) 500 (e.g., credit cards, identification cards, etc.) may be disposed within the pocket 190 of the brassiere 100, as best illustrated in FIGS. 5A and 5B. Similar to that described above for the portable electronic device 400, the first section 220 of the top edge 212 of the first fabric panel 210 is resiliently configurable between an open configuration B, which creates an opening 240 sized to receive the card(s) 500, and a closed configuration A, where the opening 240 is either not present or is sized to not receive the card(s) 500. Thus, when the first section 220 of the first fabric panel 210 is in the open configuration B, the card(s) 500 may be inserted into the pocket 190 through the opening 240, but when the first section 220 is in the closed configuration A, the card(s) 500 placed inside the pocket 190 are prevented from exiting the pocket 190. Furthermore, when the first section 220 is in the closed configuration A, card(s) 500 located outside of the pocket 190 are prevented from entering the pocket 190. The resiliency of the first section 220 of the first fabric panel 210 of the pocket 190 serves to retain the card(s) within the pocket 190 during use of the brassiere 100, and only allows the card(s) to be removed from, or placed within, the pocket 190 when the wearer of the brassiere 100 desires to remove or place the card(s) 500 within the pocket 190.

Similar to the portable electronic device 400, the card(s) 500 may be visible through the porous material 420 of the first fabric panel 210. This enables the wearer of the brassiere 100 to easily choose the card 500 they would like access/remove from the pocket 190 when there are multiple cards 500 disposed within the pocket 190. The visibility through the porous material 420 may also allow the wearer of the brassiere 100 to more easily access and remove other objects (e.g., keys, money, etc.) without searching within the pocket 190.

Figure 3:
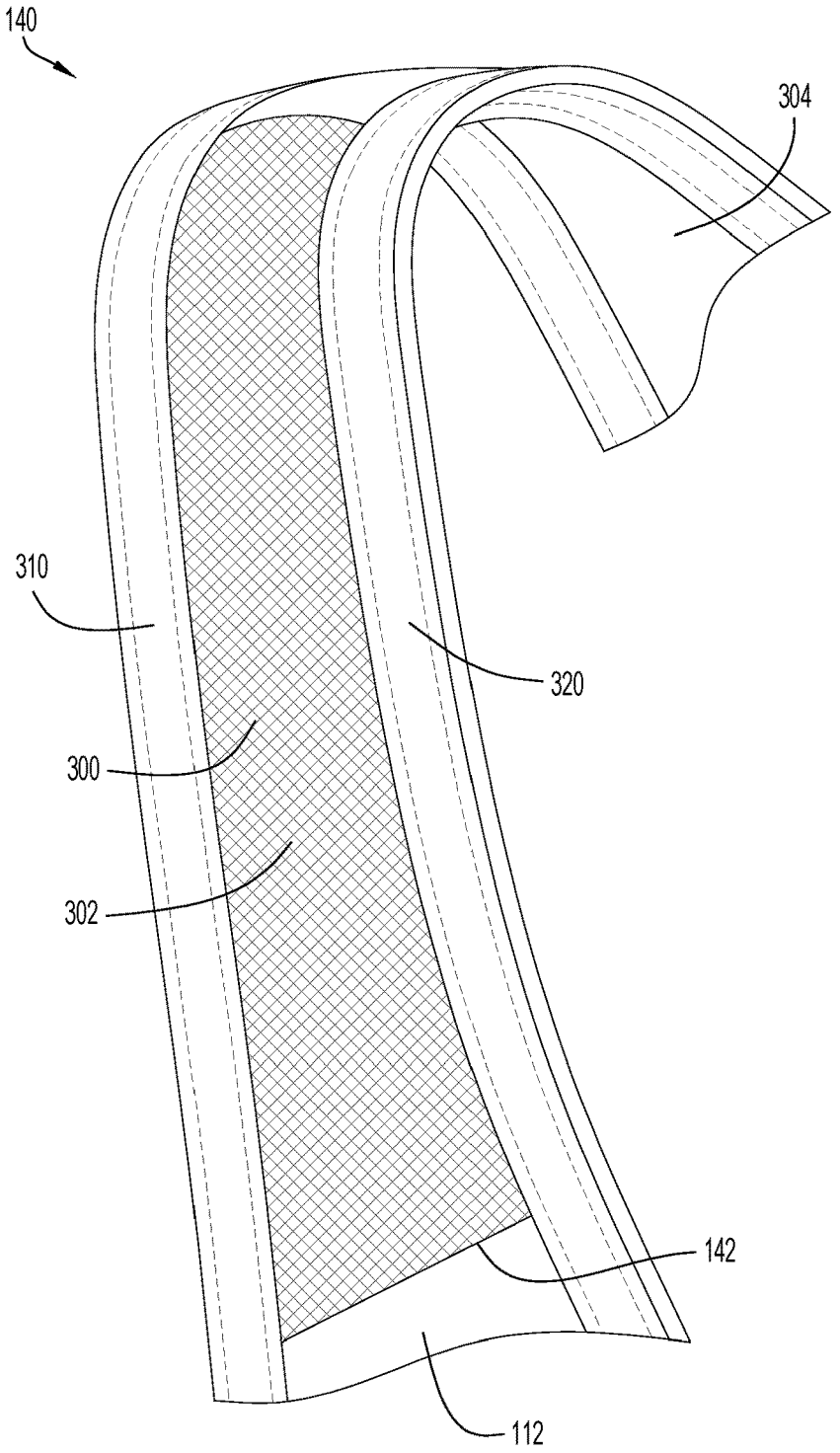
FIG. 3 illustrates a front view of one of the straps of the embodiment of the brassiere illustrated in FIG. 1A.

As illustrated in FIG. 3, the first strap 140 may also be constructed from a porous material. While FIG. 3 only illustrates the first strap 140, the discussion of FIG. 3 also applies to the second strap 150 because the first and second straps 140, 150 are mirror images of one another. As illustrated in FIG. 3, the first strap 140 includes a central section 300 with a first or outer trim portion 310 and a second or inner trim portion 320 coupled to the edges of the central section 300. The first and second trim portions 310, 320 may be each constructed of a piece of fold over elastic fabric that contains a degree of resiliency and is configured to stretch. The first and second trim portions 310, 320 are coupled to both the outer and inner surfaces of the central section 300 such that the first and second trim portions 310, 320 are folded over the edges of the central section 300.

In the embodiment illustrated, the central fabric panel 300 may be constructed from multiple fabric panels. As illustrated in FIG. 3, the central panel 300 of the first strap 140 includes a front fabric panel 302 and a rear fabric panel 304. The front fabric panel 302 is disposed proximate to the first end 142 of the first strap 140, while the rear fabric panel 304 may be disposed proximate to the second end 144 of the first strap 140. The front fabric panel 302 may be constructed from a porous material, such as a warp knit mesh fabric containing 60% elastane and 40% nylon. The use of a porous material for the front fabric panel 302 permits the flow of fluid (e.g., air, moisture, etc.) therethrough. Thus, the front fabric panel 302 promotes the hot air and sweat produced by the wearer of the brassiere to flow through the front fabric panel 302 and away from the body of the wearer of the brassiere 100. The front fabric panel 302 also promotes the flow of cooler air through the front fabric panel 302 to cool the portion of the body disposed underneath the front fabric panel 302. Furthermore, the front fabric panel 302 may contain a degree of resiliency and may be configured to stretch, which enables the first strap 140 to conform to the shoulders of the wearer of the brassiere 100. This promotes a more comfortable fit for the brassiere 100 on the wearer. The rear fabric panel 304 may be less porous than the front fabric panel 302, where the rear fabric panel 304 is constructed from a blended fabric consisting of 87% polyester and 13% elastane. The rear fabric panel 304 may also contain a degree of resiliency and may be configured to stretch. The rear fabric panel 304 may, however, contain a lower degree of resiliency than the front fabric panel 302, which prevents the rear fabric panel 304 from stretching as much as the front fabric panel 302.

As described above, the pocket 190 of the brassiere 100 enables items or objects, and particularly portable electronic devices 400, to be stored and secured during activities (i.e., workouts, running errands, etc.). Securing items within the pocket 190 of the brassiere 100 may prevent items from getting lost in pockets or from being dropped while a wearer of the brassiere 100 holds the items in their hand. In some instances, the other articles of clothing of the wearer of the brassiere 100 may not have any pockets. In these instances, the pocket 190 on the brassiere 100 enables items, particularly important personal items (i.e., a portable electronic device 400, credit and/or identification cards 500, keys, etc.), to be secured to the wearer of the brassiere 100 without needing to be held in the hands of the wearer (i.e., freeing up the hands of the wearer of the brassiere 100 for working out or for performing other activities). The location and resilient nature of at least the first fabric panel 210 (i.e., the porous material 420, the first section 220 of the top edge 212, etc.) of the pocket 190 also enables the wearer to quickly secure items within, and remove items from, the pocket 190.

While the invention has been described in detail and with reference to specific embodiments thereof, it will be apparent to one skilled in the art that various changes and modifications can be made therein without departing from the spirit and scope thereof.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A sports brassiere configured to be worn on a torso of a wearer, the brassiere comprising:

a body including shoulder straps and breast cups, the body defining a lower edge;

a resilient band coupled to the lower edge of the body along a seam; and a pocket disposed on the resilient band, the pocket comprising a textile cover panel coupled to the resilient band to define a pocket storage cavity, wherein the textile cover panel is configured to permit the wearer to directly contact an object positioned in the storage cavity through the cover panel.

2. The brassiere of claim 1, wherein:

the brassiere defines a front brassiere side and a rear brassiere side; and the pocket is disposed on the band such that the pocket is accessible from the front brassiere side.

3. The brassiere of claim 2, wherein the cover panel comprises strands intertwined to define a plurality of apertures between the strands.

4. The brassiere of claim 3, wherein the strands are resilient yarns, hard yarns, or a combination thereof.

5. The brassiere of claim 4, wherein the wearer directly contacts an object positioned in the storage cavity via the plurality of apertures.

6. The brassiere of claim 5, wherein:

the object stored in the pocket is a mobile device including a capacitive surface that is configured to be contacted by a wearer through the cover panel to manipulate the capacitive surface.

7. The brassiere of claim 6, wherein the cover panel is mesh fabric having apertures of about 0.5 mm to about 2.5 mm.

8. The brassiere of claim 1, wherein:

the cover panel is an outer panel defining an outer panel top edge, an outer panel bottom edge opposite the outer panel top edge, an outer panel first edge, and an outer panel second edge opposite the outer panel first edge; and a portion of the outer panel top edge is decoupled from the resilient band to define an opening providing access to the pocket storage cavity.

9. The brassiere of claim 8, wherein the decoupled portion of the outer panel top edge is an arcuate notch formed into the outer panel.

10. The brassiere of claim 1, wherein the band is configured to encircle the torso of the wearer.

11. The brassiere of claim 10, wherein the band is a continuous band encircling the torso of the wearer.

12. A brassiere configured to be worn on a torso of a wearer, the brassiere comprising:

a body including shoulder straps, the body defining a lower edge;

a resilient band extending continuously along the lower edge of the body, the resilient band being coupled to the lower edge of the body along a seam; and a pocket on the resilient band and defining a storage cavity, the pocket comprising a cover panel coupled to the resilient band, wherein the cover panel is constructed of strands intertwined such that apertures are defined between the strands.

13. The brassiere of claim 12, wherein the apertures are configured to permit viewing of an object positioned within the pocket storage cavity.

14. The brassiere of claim 13, wherein the apertures are further configured to permit the wearer to directly contact an object positioned within the pocket storage cavity.

15. The brassiere of claim 14, wherein the strands are selected from the group consisting of resilient yarns, hard yarns, and a combination of resilient yarns and hard yarns.

16. The brassiere of claim 15, wherein:

the brassiere defines an interior, wearer-facing side and an exterior side opposite the interior wearer-facing side; and the pocket is located on the exterior side of the brassiere.

17. The brassiere of claim 16, wherein:

the brassiere further defines a front side and a rear side opposite the front side; and the pocket is located within the front side of the brassiere.

18. The brassiere of claim 17, wherein the cover panel further includes an arcuate notch to enable access to the pocket storage cavity.

19. The brassiere of claim 18, wherein the cover panel is mesh fabric having apertures of about 0.5 mm to about 2.5 mm.

* * * * *